US008657668B1

(12) United States Patent
Coronel et al.

(10) Patent No.: US 8,657,668 B1
(45) Date of Patent: Feb. 25, 2014

(54) SYSTEM AND METHOD FOR CONDUCTING A WAGERING GAME AND AWARDING VIRTUAL CURRENCY FROM WAGERING GAME ACTIVITY

(71) Applicants: Jack Bertram Coronel, Las Vegas, NV (US); Joseph R Coronel, Las Vegas, NV (US)

(72) Inventors: Jack Bertram Coronel, Las Vegas, NV (US); Joseph R Coronel, Las Vegas, NV (US)

(73) Assignee: JRC Holdings LLC, Las Vegas, NV (US)

( * ) Notice: Subject to any disclaimer, the term of this patent is extended or adjusted under 35 U.S.C. 154(b) by 0 days.

(21) Appl. No.: 13/844,072

(22) Filed: Mar. 15, 2013

(51) Int. Cl.
*A63F 9/24* (2006.01)

(52) U.S. Cl.
USPC ..... 463/22; 463/42

(58) Field of Classification Search
USPC ..... 463/22, 42
See application file for complete search history.

(56) References Cited

U.S. PATENT DOCUMENTS

| | | | | |
|---|---|---|---|---|
| 7,887,404 | B2 | 2/2011 | Saffari et al. | |
| 2002/0151365 | A1* | 10/2002 | Walker et al. | 463/42 |
| 2003/0083943 | A1* | 5/2003 | Adams et al. | 705/14 |
| 2007/0093299 | A1 | 4/2007 | Bergeron et al. | |
| 2007/0167239 | A1* | 7/2007 | O'Rourke | 463/42 |
| 2010/0041472 | A1* | 2/2010 | Gagner et al. | 463/26 |
| 2010/0197385 | A1 | 8/2010 | Aoki et al. | |
| 2011/0300926 | A1* | 12/2011 | Englman et al. | 463/25 |
| 2013/0059637 | A1* | 3/2013 | Lima et al. | 463/13 |
| 2013/0095914 | A1* | 4/2013 | Allen et al. | 463/25 |

* cited by examiner

*Primary Examiner* — Tramar Harper
(74) *Attorney, Agent, or Firm* — Robert Ryan Morishita; Morishita Law Firm, LLC

(57) ABSTRACT

A method and system for providing virtual currency in a non-wagering game through activity in a wagering game includes non-wagering game terminals and wagering game terminals. As a wagering game is conducted at wagering game terminals, activity may be directly measured or measured through a proxy such as player units awarded by a player tracking server. Activity data may be received at an account server which accrues virtual currency to a player's virtual currency account. The virtual currency stored in the virtual currency account is accessible by the player in the non-wagering game.

20 Claims, 8 Drawing Sheets

SYSTEM AND METHOD FOR CONDUCTING A WAGERING GAME AND AWARDING VIRTUAL CURRENCY FROM WAGERING GAME ACTIVITY

FIELD OF THE INVENTION

The present invention relates to game systems and methods. More particularly, the present invention is a system and method for conducting a transaction or series of transactions in which activity in a wagering game is linked to a virtual economy of a separate non-wagering multi-player game.

BACKGROUND OF THE INVENTION

The word "gaming" refers to two different concepts in the entertainment industry. In one context, sometimes referred to as entertainment gaming, the word "gaming" refers to computer or video games in which play is conducted from a gaming console, arcade machine, personal computer, cellular telephone, personal digital assistant ("PDA"), or the like. In entertainment gaming, the player usually exercises skill, logic, strategy, and luck to influence the outcome of the game. Games within the entertainment gaming genre may take many different forms, including games for individuals to compete against a computer-controlled opponent (or a standard, such as a game timer or minimum score), games for individuals to compete against other individuals, games for teams to compete against other teams, or the like. While some games involve some payment, the payment is not a "wager." That is, entertainment games usually require a payment for the purchase or license of the game and/or a payment to play the game in a specific forum, such as specially designated networks or the like. However, such a payment is not in the form of a wager since the payment is typically not staked for participation in the game and typically is not used to determine eligibility for a tangible prize.

Entertainment games may be conducted in single player or multi-player environments with each player playing the game at a separate terminal, such as a personal computer, that communicates with a server coordinating the game. Massively Multi-player Online Games ("MMOG") such as World of Warcraft™ and EverQuest™ are examples of games with multi-player play. Real time simulation ("RTS") games such as Farmville™ and Mafia Wars™ are examples of games with multi-player social interaction. The advent of social networking websites, such as Facebook™, has drawn even more players to games with multi-player play and/or multi-player social interaction. Many of these games form virtual communities including virtual economies in which players can purchase in-game items and products for use in the game.

The word "gaming" may also be used to refer to casino gaming. Regardless of whether the gaming occurs in an actual, physical casino, these types of casino or wagering games usually include three components: a wager, chance, and a reward. That is, casino or wagering games are usually games in which the outcome of a wager, that is, the reward, is determined by chance, which predominates over every other factor, including skill. For example, although some skill is involved in card games such as poker, blackjack, or the like, chance predominates. Specifically, chance, rather than the player's skill, determines which cards are dealt to the players, which cards are dealt to a dealer, if any, which cards are cut from the deck or shoe of cards, and so forth. In other wagering games, such as reel slot games, numbers games (such as bingo, keno, lotto, pull tabs, or the like), dice games, wheel games (such as roulette), or the like, chance is practically the only factor to determine the outcome of the wagering game, with skill having no influence on the symbols or numbers spun, drawn, or rolled.

As may be appreciated, the outcomes of wagering games can usually be determined by the strict probabilities that govern the games and, therefore, the hold for the game operator over the long term can be predicted. As may further be appreciated, this may not be true for skill games, in which the outcomes would vary from player to player based on the player's skill. As may be appreciated, wagering games must be operated for a profit over the long term and would generally not operate games that allow certain players to improve their performance through practice. Consequently, casinos will not, and in some jurisdictions cannot, offer games in which skill predominates.

Additionally, the systems used to conduct casino or wagering games are typically not equipped to operate entertainment games. Entertainment games are typically graphics intensive and, among newer games, are typically played in a multi-player format with each player using a separate terminal that communicates with a game server. While machines operating wagering games may be networked or linked to a controller or server, the network traffic usually consists of accounting data (wagers, awards, and so forth) and does not allow interaction among the players at the individual wagering game terminals. Similarly, a link controller or server does not create a virtual environment or coordinate play at the various gaming machines in the virtual environment.

SUMMARY OF THE INVENTION

A system and method for conducting games for a plurality of players, links a real economy with a virtual economy. One such system includes at least one wagering game terminal having a wagering game terminal interface and a means for generating a random number, such as a random number generator, ball blower, interface to trigger a manual draw, or the like. The wagering game terminal executes program instructions to receive a wager through the wagering game interface. The wagering game terminal conducts a game of chance to generate at least one outcome based on a random number generated by the means for generating a random number, e.g., random number generator. At least one of the possible outcomes is associated with an award accrued to a register of stored game credits exchangeable for real currency.

A plurality of non-wagering game terminals is also provided. Each non-wagering game terminal has a non-wagering game terminal interface. The non-wagering game terminals execute program instructions to conduct a non-wagering game. The non-wagering game includes a virtual economy in which players utilize virtual currency to purchase features in the non-wagering game through the non-wagering game terminal interface. In an optional embodiment, the non-wagering game terminals access a virtual currency record containing data representing a quantity of virtual currency, in which at least a portion of the virtual currency is accrued based on play of the wagering game at the wagering game terminal. Optionally, the virtual currencies may be of different types based on issuer, user, use, or the like. For example, different types of virtual currencies may be usable for different virtual economies, different retailers, different games, or the like.

In one optional embodiment, an account server communicates with the non-wagering game terminals and, directly or indirectly, the wagering game terminal(s). The account server stores a virtual currency record for each of a plurality of players. Each virtual currency record contains data representing at least a quantity of virtual currency. Optionally, the virtual currency record may also contain data representing a type of virtual currency, such that different types of virtual currencies may be distinguished. At least a portion of the virtual currency is accrued based on play of the wagering game at the wagering game terminal. For example, in one optional embodiment, at least a portion of the virtual currency is accrued based on at least one of: one or more outcomes in the wagering game for the player; one or more awards in the wagering game for the player; game credits used at the wagering game terminal (e.g. stored, won, lost, bought, accrued, paid, received, wagered, or the like) by the player; activity on or at the wagering game terminal by the player; the position and/or state of the wagering game terminal; or the like.

In a further optional embodiment, a player tracking server communicates with the wagering game terminal and the account server. The player tracking server stores a player tracking record for each of a plurality of players. Each player tracking record contains data representing a quantity of player units, such as player points, player score, player ranking, or the like. In one such optional embodiment, at least a portion of the player units are earned based on play of the game of chance at the wagering game terminal. Optionally, at least the portion of the virtual currency accrued at the account server is based on the play of the game of chance at the wagering game terminal as communicated by the player tracking server. In a further optional embodiment, at least a portion of the virtual currency accrued at the account server is based on the player units earned by the player in addition to, or in place of, at least one of: one or more outcomes in the wagering game for the player; one or more awards in the wagering game for the player; game credits used at the wagering game terminal (e.g. stored, won, lost, bought, accrued, paid, received, wagered, or the like) by the player; activity on or at the wagering game terminal by the player; the position and/or state of the wagering game terminal; or the like. In such an optional embodiment, virtual currency may translate to player units in a variety of ways. For example, the virtual currency accrued may be equal to the player units, may be proportional to the player units, may be earned up to a predetermined maximum limit of the player units, may be earned above a predetermined minimum limit of the player units, or the like.

DESCRIPTION

Reference is now made to the figures wherein like parts are referred to by like numerals throughout. Referring to FIGS. 1-8, an embodiment of the present invention includes a system and method for linking activity in a wagering game to a virtual economy in a non-wagering game. An embodiment of the present invention may be applied to any wagering game or non-wagering game. That is, the present invention is not dependent on the specific wagering game or non-wagering game involved. Rather, the present method may be applied to any wagering game in which a wager is staked for a chance to win an award and any non-wagering game in which no wager is staked, although it is contemplated that the non-wagering game may be free, require a subscription or fee, or require other consideration for play (e.g., joining a loyalty program, submitting data used for marketing, making a purchase, or the like). It is also noted that although no wager is staked in the non-wagering game, it is contemplated that prizes, whether tangible (such as a good, service, currency, or the like) or promotional (discounts, play currency, or the like) in nature may be offered as awards in the non-wagering game.

Figure 1:
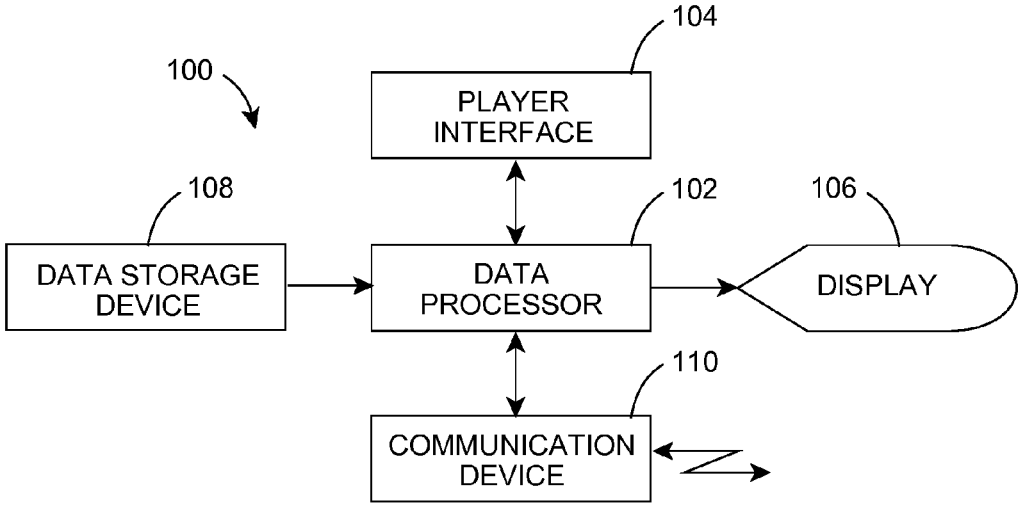
FIG. 1 is a block diagram of a wagering game terminal according to an embodiment of the present invention.

In an optional embodiment illustrated in FIG. 1, a system includes a wagering game terminal 100 having a data processor 102 in communication with a display 106, a player interface 104, a data storage device 108, and a communication device 110. The form of the wagering game terminal 100 may vary depending on the embodiment. In fact, a system according to the present invention may include many different forms or combinations of forms of wagering game terminals 100 within the system. In this regard, it is contemplated that the wagering game terminal 100 may include any form of device configured or programmed for conducting a game method, including a personal computer, electronic gaming machine, slot machine, handheld device, cellular telephone or other phone, personal digital assistant ("PDA"), kiosk, or the like.

The data processor 102 may take any form, including a conventional microprocessor. The data processor 102 may include a random number generator in the form of hardware or firmware, or may execute a random number generator in the form of software. Alternatively, a random number may be generated by a physical process, such as selection of balls from a ball blower, dealing of cards from a card shuffler or card shoe, or the like, generated through a manually triggered interface, or generated in any other fashion. It is contemplated that the random number generator may be used by the data processor 102, at least in part, to generate a number in random or quasi-random fashion. The random or quasi-random number may be used, at least in part, to produce a wagering game outcome.

The display 106 may take any form, including a cathode ray tube ("CRT") monitor, liquid crystal display ("LCD"), organic light emitting diode ("OLED") display, plasma display, television, or the like. The data processor 102 may communicate directly or indirectly, such as through a video controller or video card, with the display 106.

The player interface 104 may include an input device to receive input from a player and transmit it to the data processor 102. Such an input device may take any form, such as mouse, pointer, keyboard, keypad, button panel, mobile or wireless device, or the like. In an optional embodiment, the input device may be integrated with the display 106 in a touchscreen device. The player interface 104 may also include a device to receive wagers and/or purchases of game credits. For example, the player interface may include a ticket or voucher reader, bill acceptor, coin receiver, magnetic-stripe card reader, smart card reader, bar code scanner, radio frequency identification ("RFID") transceiver, or the like. The player interface 104 may also include an output device to output currency or representations of currency for awards, cashout requests, or the like. For example, the output device could include a ticket or voucher printer, bill or coin dispenser, card encoder, bar code printer, radio frequency identification ("RFID") transceiver, or the like. It is noted that, in an optional embodiment, devices may perform multiple functions, such as reading tickets or vouchers and accepting bills.

A communication device 110 may take any form, including a modem, wired or wireless network interface card ("NIC"), or the like. As illustrated in FIGS. 3-6, a wagering game terminal 100 may communicate through a communication device 110 to an account server 304 directly or indirectly. For example, a wagering game terminal 100 may communicate with an account server 304 through an intermediary, such as a player tracking server 310, intermediary server 312, or the like.

A data storage device 108 may take any form including magnetic storage, optical storage, flash storage, or the like. The data storage device 108 may store executable program instructions for the data processor 102 to conduct a wagering game, along with graphics, sounds, social media content, and game parameters for conducting the game. As suggested above, in an optional embodiment in which a random number generator takes the form of software, the data storage device 108 may also store executable program instructions for the data processor 102 to generate a random number. As may be appreciated, the use of a random number combined with a player interface 104 that receives wagers and issues payouts satisfy most legal definitions of a wagering game, gaming device, gambling device, or similar term.

Referring generally to FIGS. 3-7, in an optional embodiment, a system includes a player tracking server 310. In one such optional embodiment, a player tracking server 310 includes a communication device (not shown). In one such embodiment, the communication device communicates with the wagering game terminal(s) 100 and, optionally, an account server (described in greater detail below). A player tracking server 310 may include a data storage device (not shown) storing player tracking records. Optionally, player tracking records store data representing player units. Player units may take the form of player tracking points (also referred to as player reward points, player loyalty points, or the like), a player score, a player ranking, or the like, that is or are earned based, at least in part, on play and/or participation at a wagering game terminal. However, player units may take any form and may be earned or otherwise acquired in any manner, including activity at one or more wagering game terminals 100, activity at locations other than wagering game terminals 100 (such as gaming tables or non-gaming activities), exchanges, purchase activity, or the like. In an optional embodiment, player units are exchangeable for products, services, discounts on products or services, or the like.

A system also includes an account server 304. The account server 304 includes a communication device (not shown) to communicate directly or indirectly with a wagering game terminal 100 as discussed above. An account server 304 includes a data storage device (not shown) that stores virtual currency records, optionally in a database. It is contemplated that the virtual currency record may be stored independently, or may include other stored information, such as player information, game information, or the like. A virtual currency record represents a quantity of virtual currency for a player.

It is contemplated that virtual currency may also have a characteristic of "type," with different types of virtual currency used and/or earned in different ways. For example, the type of virtual currency may be designated as it is earned (e.g., platinum, gold, silver and bronze) and used and/or earned based on its particular type. Alternatively, virtual currency may be earned generically, that is, all virtual currency is fungible, however upon use it is designated with a type. An example would be that virtual currency redeemed during a certain time period is worth 3× its face value. In such an optional embodiment, a virtual currency record may also represent a type for the virtual currency or virtual currencies tracked in that virtual currency record.

It is contemplated that a player tracking server 310 and an account server 304 may be separate devices, or may be combined in a single device. That is, a single combined player tracking server/account server may act to store both player tracking records and virtual currency records, as well as communicate with both wagering game terminals and non-wagering game terminals. In an optional embodiment, additional information may also be stored, such as player preferences, player history, or the like, at either a player tracking server, account server, or combined player tracking server/account server.

A system includes non-wagering game terminals 200. The non-wagering game terminals 200 may take any form, including a personal computer, electronic game console, arcade machine, handheld device, cellular telephone or other phone, personal digital assistant ("PDA"), kiosk, or the like. It is contemplated that the non-wagering game terminals 200 may also function as wagering game terminals 100, i.e., terminals may be configured to conduct both wagering games and non-wagering games. Alternatively, it is contemplated that non-wagering game terminals 200 may be separate from wagering game terminals 100, i.e., terminals may be configured to conduct wagering games or non-wagering games, but not both. In yet another system, some terminals may be specifically configured for wagering games or non-wagering games, while other terminals may be configured for both wagering games and non-wagering games.

Figure 2:
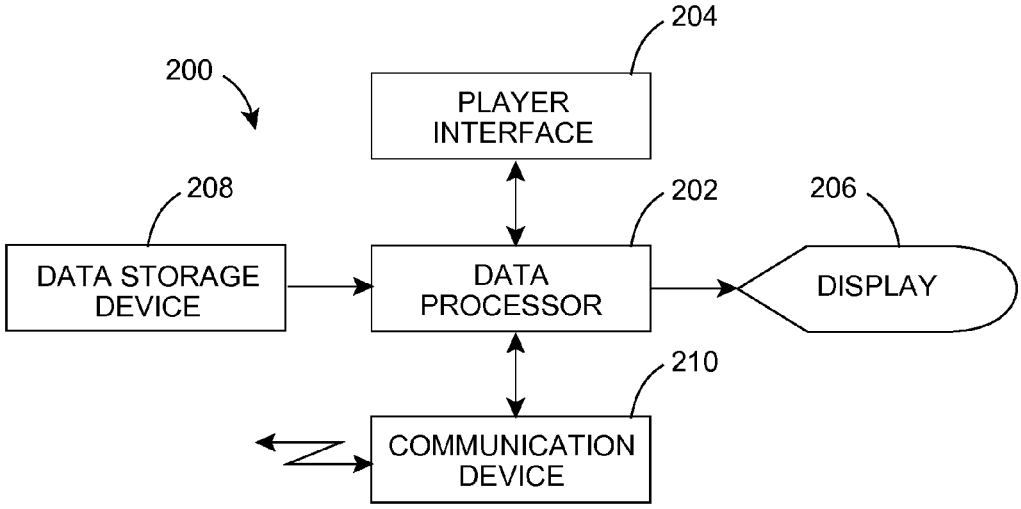
FIG. 2 is a block diagram of a non-wagering game terminal according to an embodiment of the present invention.
Figure 3:
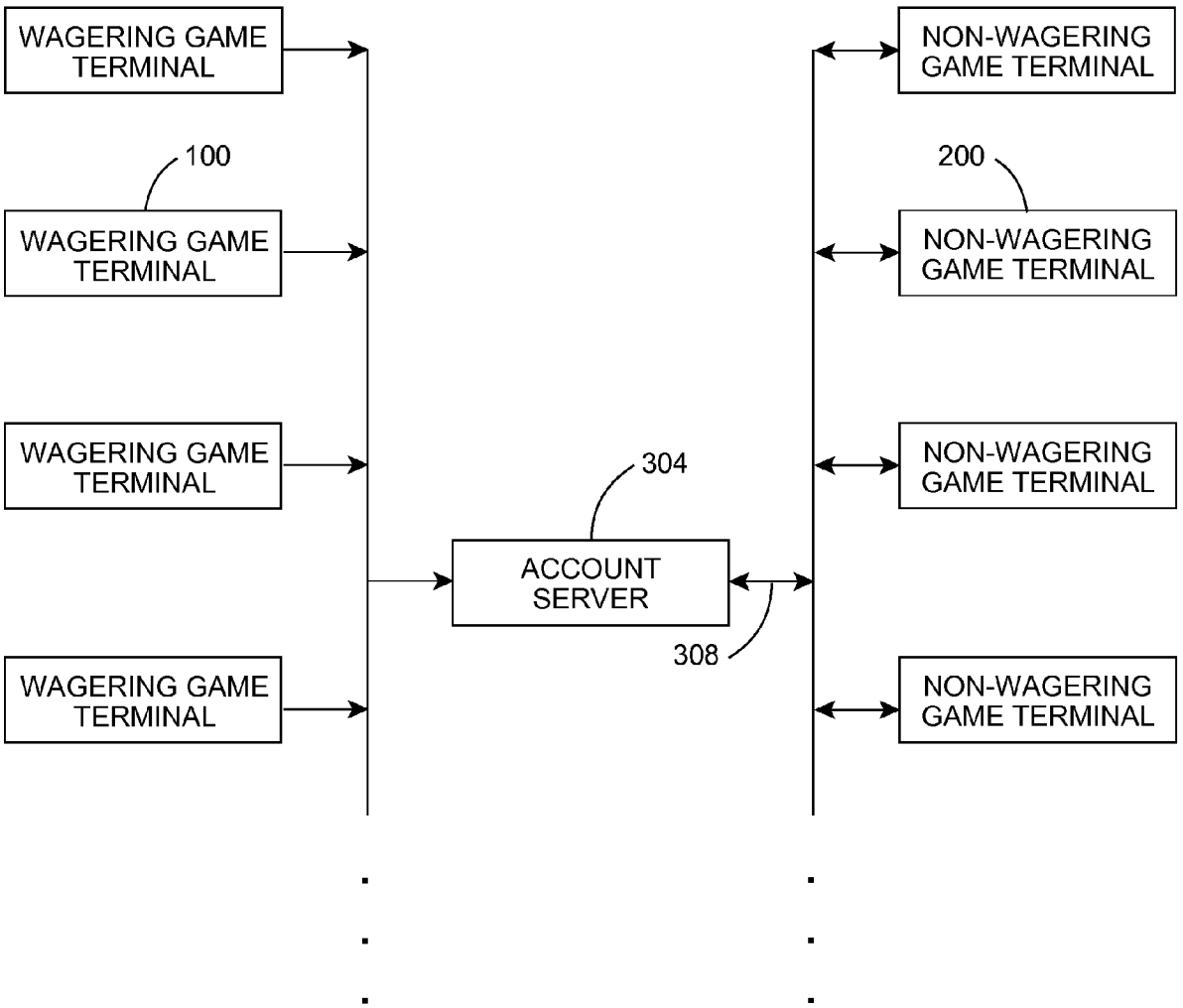
FIG. 3 is a block diagram of a system according to an embodiment of the present invention.

As illustrated in the optional embodiment of FIG. 2, a non-wagering game terminal 200 may include a data processor 202, display 206, a player interface 204, a data storage device 208, and communication device 210. The data processor 202 may take the form of a microprocessor and may execute program instructions to conduct a non-wagering game. In an optional embodiment in which the non-wagering game terminal is a general purpose computer, the data processor 202 may also execute instructions to perform other tasks.

As with the wagering game terminal, the display 206, player interface 204, data storage device 208, and communication device 210 of the non-wagering game terminal 200 may take any form. The player interface 204 may include an input device, such as a keyboard, keypad, mouse, pointer, game controller, touchscreen, pointer, or the like, for providing input to the non-wagering game. Additionally, the player interface 204 may receive fees or payments for conducting non-wagering games. Fees or payments may be distinguished from wagers, in that fees or payments are typically not staked on the outcome of a game with a possible reward earned based, at least in part, on the outcome.

The data storage device 208 of the non-wagering game terminal 200 may store executable program instructions for the data processor 202 to conduct a non-wagering game. In this respect, a non-wagering game may include some chance elements. However, in distinguishing a non-wagering game from a wagering game, at least one of three elements, namely chance (or random events), a tangible wager, and/or a tangible reward, is eliminated from the non-wagering game, although it is contemplated that a player may stake virtual wagers or receive virtual rewards in a non-wagering game without converting a non-wagering game to a wagering game.

The communication device 210 of the non-wagering game terminal 200 may communicate with an account server 304. It is also contemplated that the non-wagering game terminal 200 may communicate with one or more wagering game terminals 100 and/or a player tracking server 310. Additionally, it is contemplated that the non-wagering game terminal 200 may communicate directly or indirectly, such as through an intermediary server 312, with the account server 304.

A system may be configured in a variety of ways. Examples of system configurations are illustrated in FIGS. 3-7. These examples should be understood as illustrative of possible system configurations rather than limiting. In one optional embodiment shown in FIG. 3, a plurality of wagering game terminals 100 and a plurality of non-wagering game terminals 200 communicate directly with an account server 304. The account server 304 and wagering game terminals 100 may communicate in any manner, including via network, Internet, virtual private network ("VPN"), publicly switched telephone network ("PSTN"), cellular communication, or the like. The account server 304 and non-wagering game terminals 200 may likewise communicate in any manner. In one optional embodiment, the non-wagering game terminals 200 include personal computers and the account server 304 communicates with the non-wagering game terminals via the Internet 308.

Figure 4:
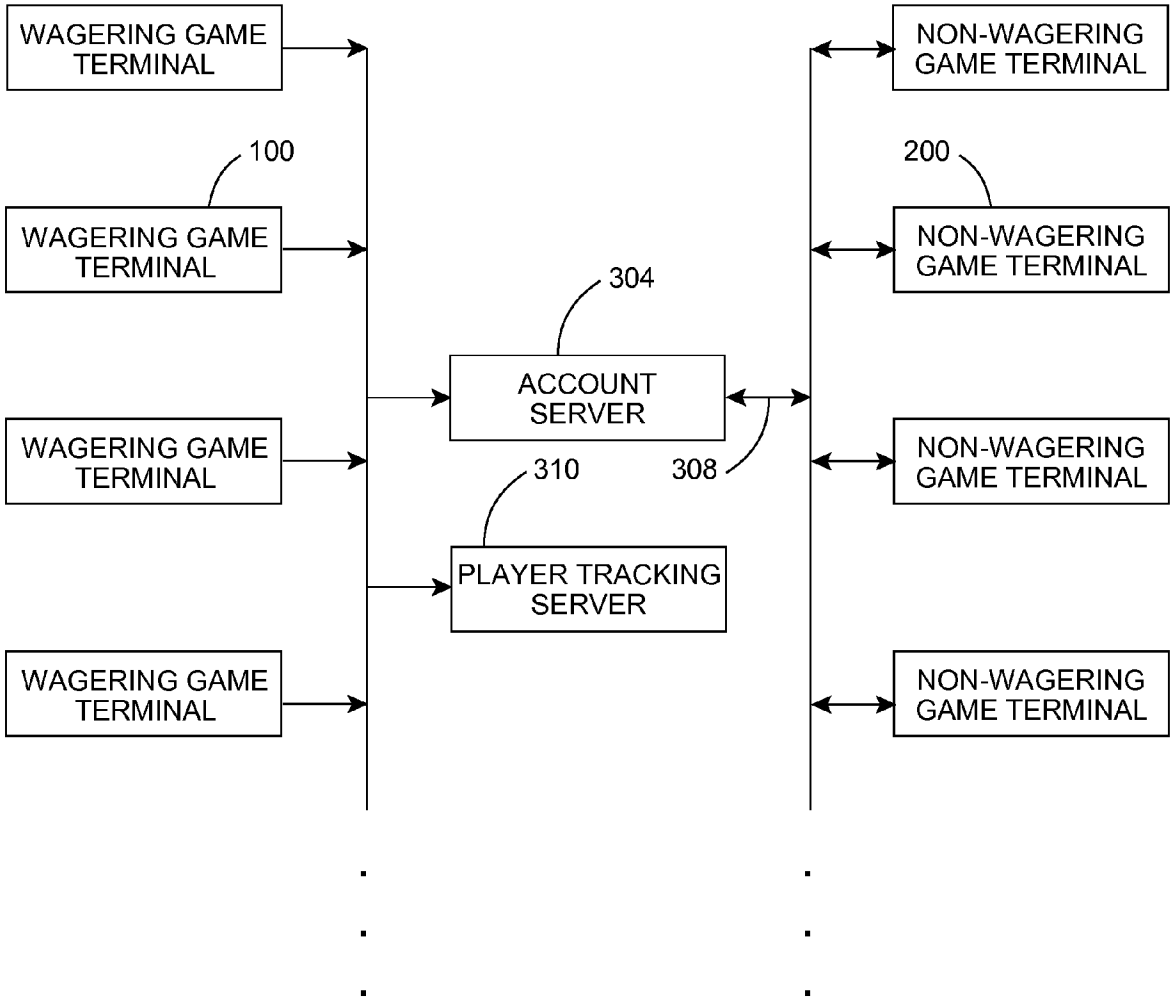
FIG. 4 is a block diagram of a system according to an embodiment of the present invention.

Referring to FIG. 4, another optional embodiment may include a player tracking server 310 communicating with wagering game terminals 100. The player tracking server 310 may communicate with the wagering game terminals 100 in any manner Conventionally, player tracking servers communicate with wagering game terminals via a wired or wireless local area network ("LAN") or wide area network ("WAN"), and the present configuration may utilize existing network architecture. In the configuration of FIG. 4, wagering game terminals 100 also communicate with an account server 304 in any manner, including those described above.

Figure 5:
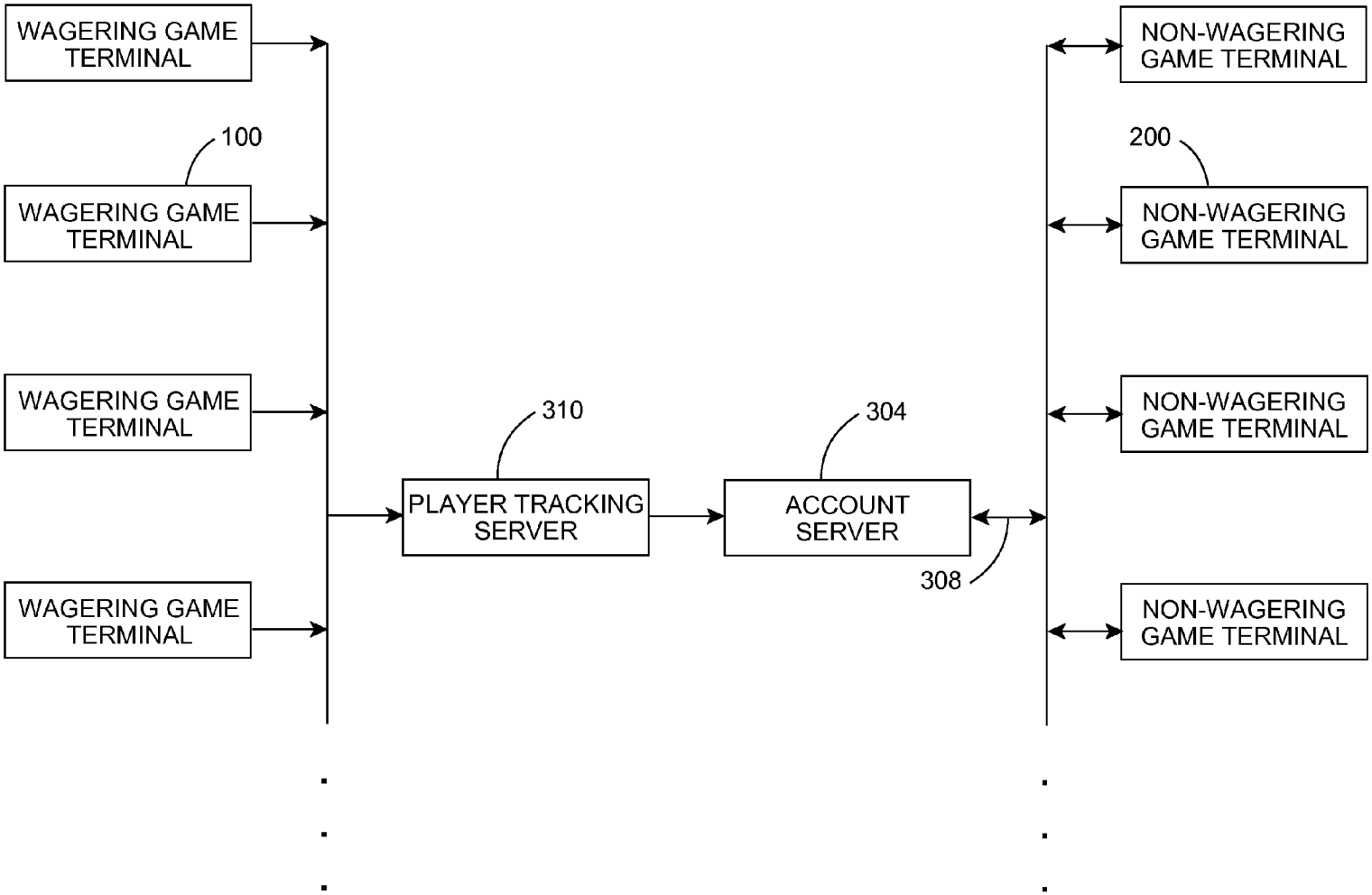
FIG. 5 is a block diagram of a system according to an embodiment of the present invention.

In another optional embodiment, illustrated in FIG. 5, a player tracking server 310 may be interposed between wagering game terminals 100 and an account server 304. Thus, in this optional embodiment, a player tracking server 310 communicates with both a network of wagering game terminals 100 and an account server 304. The communication may occur in any manner. The account server 304, in turn, communicates with a plurality of non-wagering game terminals 200.

Figure 6:
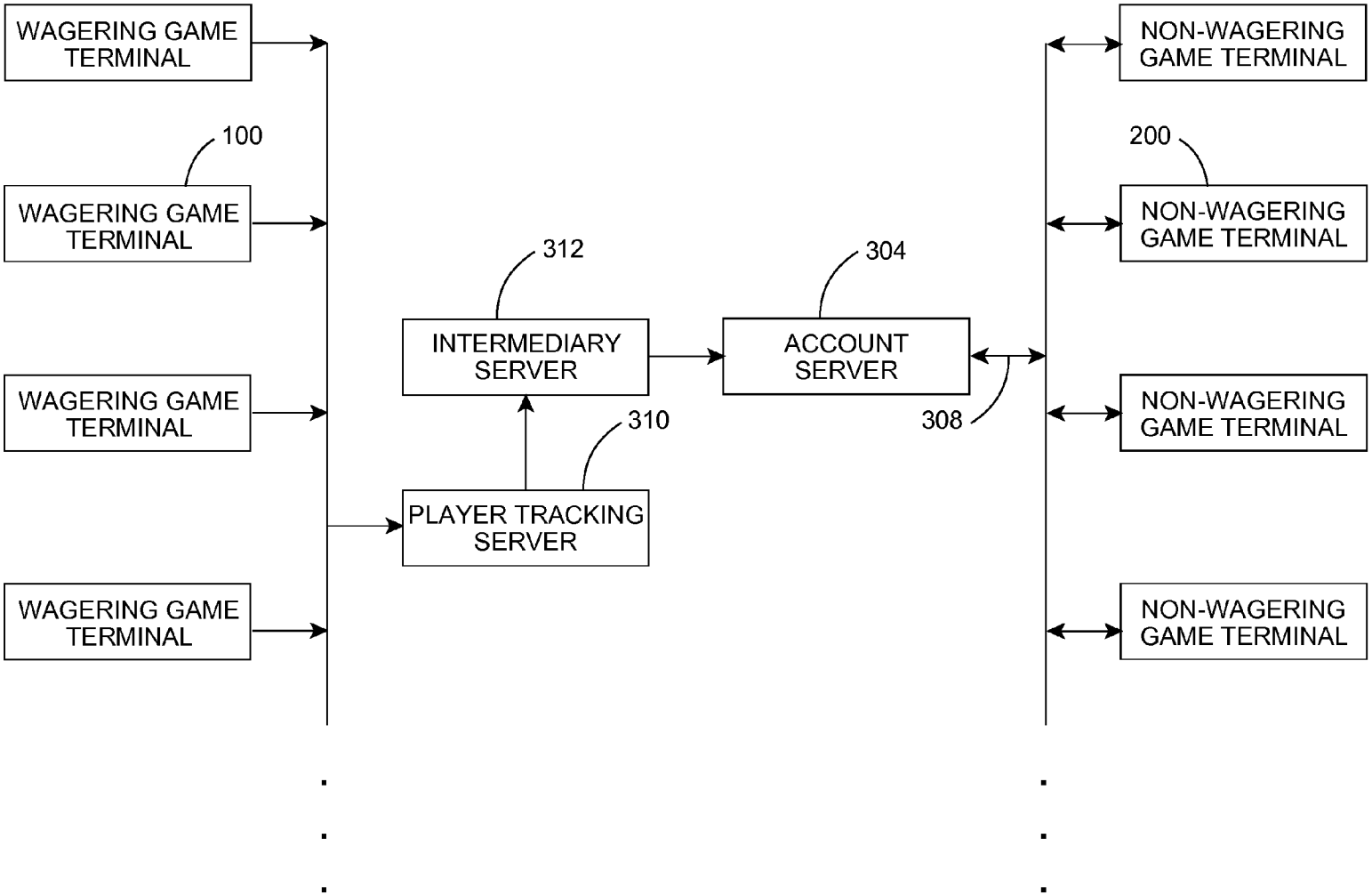
FIG. 6 is a block diagram of a system according to an embodiment of the present invention.
Figure 7:
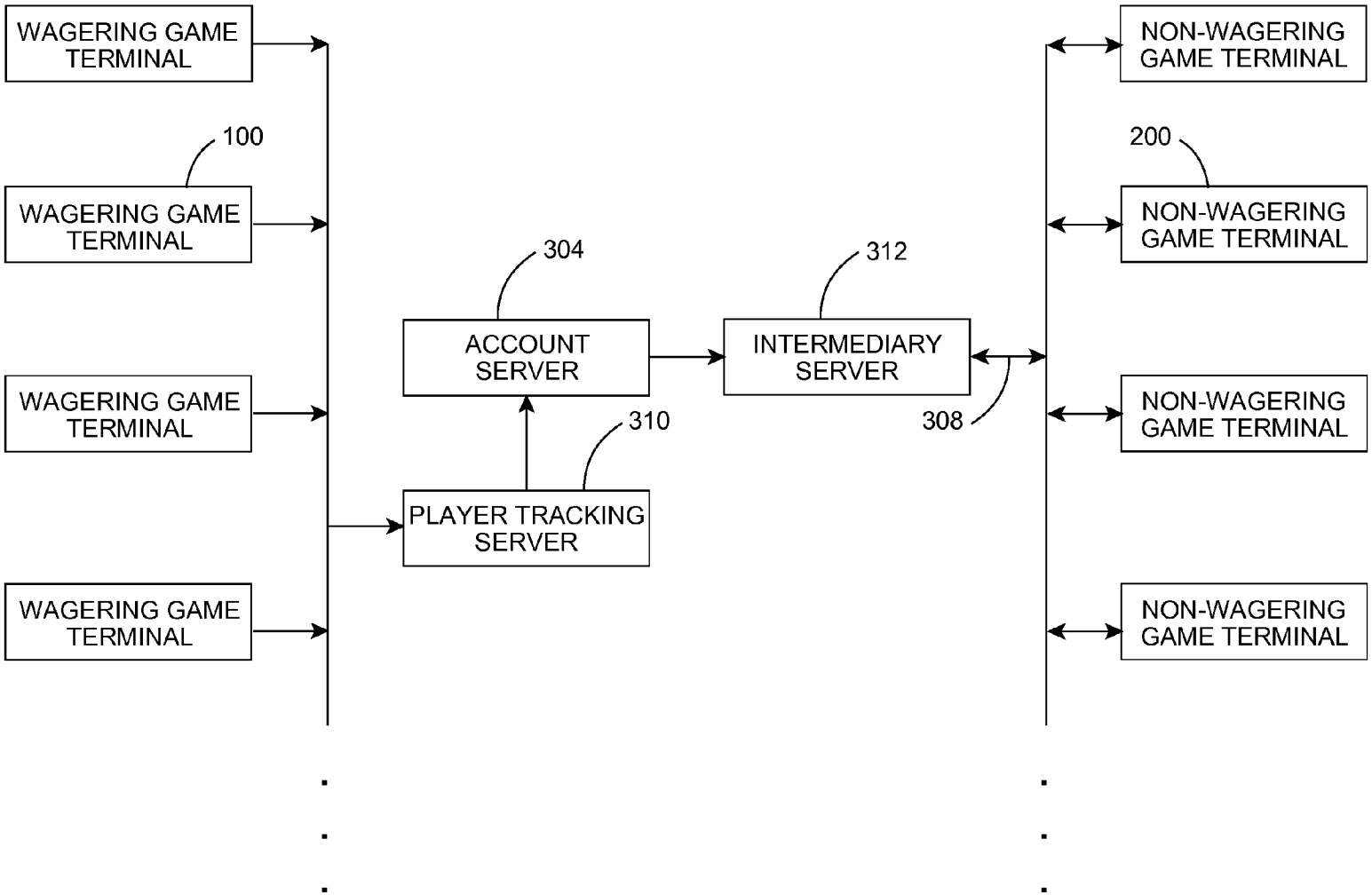
FIG. 7 is a block diagram of a system according to an embodiment of the present invention.

Referring to FIGS. 6 and 7, an intermediary server 312 may be interposed into the network. Such an intermediary server 312 may be included for efficiency in network traffic, efficiency in processing, security, and/or the like. For example, it may be undesirable for a player tracking server 310 and/or wagering game terminal 100 to communicate with an outside server such as an account server 304. In such an optional embodiment, an intermediary server 312 may be introduced to strip sensitive information and firewall a player tracking server 310 from the outside devices. As illustrated in FIGS. 6 and 7, an intermediary server 312 may be introduced anywhere in the network, including between the player tracking server 310 and an account server 304, between an account server 304 and a network of non-wagering game terminals 200, between a network of wagering game terminals 100 and a player tracking server 310, or the like.

Figure 8:
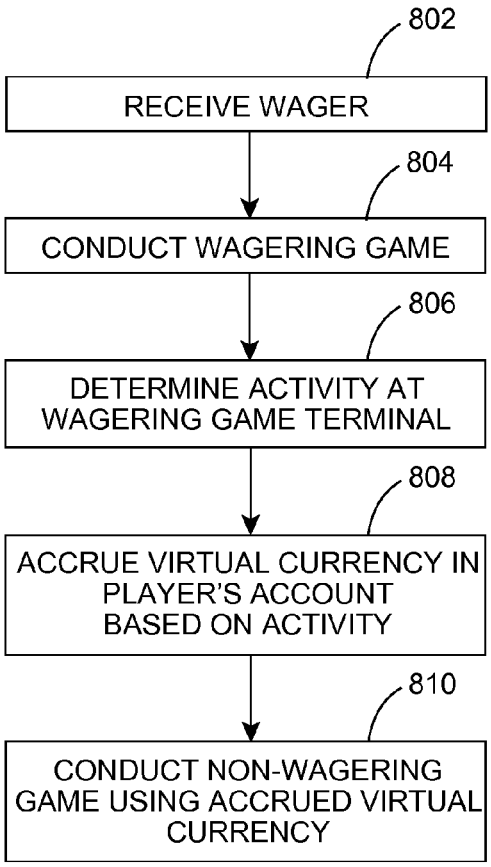
FIG. 8 is a flowchart of a method according to an embodiment of the present invention.
Figure 9:
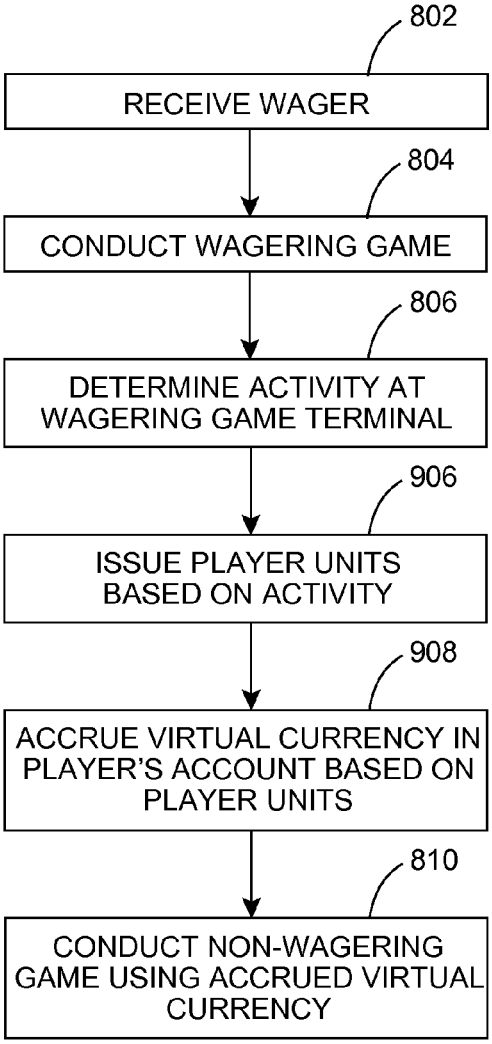
FIG. 9 is a flowchart of a method according to an embodiment of the present invention.

As illustrated in FIGS. 8 and 9, an embodiment of the present invention further includes a method for operating a system. An account server 304 stores virtual currency records for players. Non-wagering game terminals 200 are programmed to conduct a non-wagering game including a virtual economy utilizing virtual currency as recorded in the virtual currency records at an account server 304. For example, a non-wagering game may be a multi-player game with social interaction in which virtual currency is used to purchase game features, character attributes, goods, tools, or the like used in the non-wagering game.

Optionally, the non-wagering game may be conducted by non-wagering game terminals in cooperation with a game server. For example, in one optional embodiment, a game server creates a non-wagering game environment and coordinates communication from various non-wagering game terminals. It is contemplated that the game server and the account server 304 may be a single device, i.e., a single device may conduct the game and maintain virtual currency accounts in virtual currency records, or the game server may be independent of the account server 304, i.e., separate devices may conduct the game and maintain virtual currency records.

The system also includes wagering game terminals 100 that conduct a wagering game. It is contemplated that a wagering game terminal 100 may conduct a wagering game entirely on its own (such as when the wagering game terminal 100 is in the form of a "standalone" slot machine or electronic gaming machine) or it may cooperate with a wagering game server (such as when the wagering game terminal 100 is part of a server-based gaming system) or a jackpot controller (such as when the wagering game terminal is part of a network of linked gaming machines). Additionally or alternatively, a wagering game may be conducted in cooperation with other wagering game terminals 100 where the game is a multi-player game such as poker. In this regard, it is noted that multi-player games may also be conducted at a single wagering game terminal 100, such as an electronic gaming table, which accommodates multiple players at a single wagering game terminal 100. Wagering game terminals 100 may also take the form of separately tracked wagering game records for games that are not conducted electronically. For example, a wagering game terminal 100 may be virtual for games conducted in paper form, such as bingo, keno, pull tab, lotto, or the like, with aggregate and/or individual game results tracked, although the wagering game terminal 100 does not actually produce or display the game result.

In one optional embodiment, wagering game terminal 100 conducts a wagering game for a player. As may be appreciated, such a wagering game may include receiving 802 a wager from a player, conducting 804 the game by generating a game outcome based, at least in part, on a means for generating a random outcome (e.g., the outcome of a random number generator, manual draw, or the like), and resolving wagers by collecting wagers for losing outcomes, rewarding wagers for winning outcomes, and, optionally, pushing wagers for tie outcomes.

Virtual currency is accrued 808 to the virtual currency record stored at an account server 304 based, at least in part, on the activity at the wagering game terminal 100. In embodiments such as those illustrated in FIGS. 3 and 4 in which wagering game terminals 100 communicate with an account server 304, activity may be determined 806 directly from activity at the gaming machine, such as coin in, wager denomination, quantity and/or variety of wagers, game session length (in time, games, or both), a combination thereof, or the like. For example, virtual currency may be accrued based on game session length (measured in time, games, or any other time factor) at a constant or varying rate based on the wager denomination, coin in, or other measure of activity. In such an example, the accrual rate may be defined so that a player accrues more virtual currency by playing for one hour wagering five quarters per game, than by playing for one hour wagering one nickel per game. Similarly, the accrual rate may be defined so that a player accrues more virtual currency by playing for one hour wagering one nickels per game, than by playing for five minutes wagering one dollar per game. In short, the virtual currency accrual rate may be defined to take into account a number of factors.

In an alternate optional embodiment, such as those shown in FIGS. 5-7, a player tracking server 310 may be included in the system. In such optional embodiments, player units are issued 906 to the player, at least in part, based on a determination 806 of the player's activity at a wagering game machine 100. The player units may be used, at least in part, to accrue 908 virtual currency for the player. It is contemplated that player units may be used as a proxy for wagering activity and that the account server 304 may receive player unit data from the player tracking server 310. In one optional embodiment, the account server 304 may accrue virtual currency for a non-wagering game based solely on data representing player units received from the player tracking server 310. In another optional embodiment, player units may be used as a factor in determining wagering activity, so that virtual currency is accrued at an account server 304 based on data representing player units in combination with other factors.

It is noted that the accrual rate need not have a one-to-one correspondence between virtual currency and wagering activity and/or player units. In other words, accrual rates need not be defined so that a player who spends twenty dollars playing a slot machine over one hour accrues twenty units of virtual currency. Likewise, accrual rates need not be defined so that a player who earns twice as many player units as another player accrues twice the virtual currency. To the contrary, accrual rates may be defined so that a player with twice as much activity and/or earning twice as many player units may accrue two, three, four, ten, a hundred, or any other multiple of virtual currency.

In an optional embodiment illustrated in FIG. 8, the account server 304 calculates the accrual of virtual currency based, at least in part, on input from the wagering game terminals 100 of data representing activity at the wagering game terminal 100. In another optional embodiment illustrated in FIG. 9, the account server 304 calculates the accrual of virtual currency based, at least in part, on input from a player tracking server 310 of data representing player tracking units. Alternatively, the accrual of virtual currency may be calculated at a player tracking server 310, an intermediary server 312, a wagering game terminal 100, a non-wagering game terminal, 200, or anywhere else in the system.

In an optional embodiment, data received from wagering game terminals 100 or a player tracking server 310 includes identifying data so that virtual currency can be accrued to the virtual currency record for the player. In an optional embodiment, identifying data may be received at a wagering game terminal 100 through input from the player; by reading the player's identification, player card, payment card, or the like; or in any other fashion, and relayed to an account server 304 directly or via a player tracking server 310. In an optional embodiment, input may also be received from the player to select a virtual currency record for accrual of virtual currency such as when the player has multiple virtual currency records for multiple player profiles and/or multiple non-wagering games.

Non-wagering games are conducted 810 at the non-wagering game terminals 200 using virtual currency stored in virtual currency records for the player. That is, the player conducts non-wagering games with a virtual currency balance that includes virtual currency accrued as a result of wagering activity at a wagering game terminal 100.

For example, a player may use a wagering game terminal 100, such as a personal computer, to conduct a wagering game at home such as online video poker. The player could input identifying data (or that data may be read from the player's identification, biometric information, or the like) to identify the player's virtual currency account. The player wagers and receives payouts in the wagering game using real money or game credits backed by real money. The player's activity at the wagering game terminal 100 is measured and virtual currency, distinguishable from real money used in the wagering game, is accrued to the player's virtual currency account at an account server 304.

Additionally or alternatively, the player may use a different form of wagering game terminal 100, such as a slot machine, video poker machine, electronic gaming table, handheld device, or the like, to conduct a wagering game at a casino. Alternatively, the wagering game terminal 100 may be virtual in that the player's activity, outcomes, results, or the like are tracked without the wagering game terminal 100 necessarily being used to display the outcomes, results, or the like, as in lotto, keno, bingo, pull tabs, or the like. Again, identifying data may be acquired from the player to identify the player's virtual currency account. In an optional embodiment, data may also be received from the player to identify the player's player tracking account. In one such optional embodiment, the data may be read from the player's player tracking card. As the wagering game is conducted for the player, the player's wagering activity is measured from the wagering game terminal 100, from the player units earned at the player tracking server 310, or a combination thereof. Virtual currency, distinguishable from player units which are not usable in the wagering game or the non-wagering game and from real money used in the wagering game, is accrued to the player's virtual currency account at an account server 304. As noted above, other activity may also result in accrual of virtual currency, such as purchases of goods or services.

A non-wagering game may be conducted for the player by a non-wagering game terminal 200. The non-wagering game terminal 200 may receive identifying information from the player so that the player is associated with the player's virtual currency account at an account server 304. In conducting the non-wagering game, the player's virtual currency account may be debited for virtual currency used.

Such a method may also be conducted in reverse. That is, in an optional embodiment, a non-wagering game may be conducted for a player at a non-wagering game terminal 200. The virtual currency earned or accrued through the non-wagering game may be stored in a virtual currency account. As virtual currency is earned or accrued in the virtual currency account, the player may earn wagering game currency usable toward wagering games conducted at a wagering game terminal 100 based on activity in the non-wagering game, the balance or rate of accrual of virtual currency, or the like. The wagering game currency may be limited in some way, such as in the form of game credits that are non-cashable and usable only for placing wagers, buying wagering games, or the like. Alternatively, the wagering game currency may be in the form of real currency or a form that is fungible like real currency.

While certain embodiments of the present invention have been shown and described it is to be understood that the present invention is subject to many modifications and changes without departing from the spirit and scope of the invention presented herein.

We claim:

1. A system for conducting a game for a plurality of players, said system comprising:

at least one wagering game terminal having a wagering game terminal interface and a random number generator, said wagering game terminal configured to execute program instructions to receive a wager through said wagering game interface and conduct a game of chance to generate at least one outcome based on a random number generated by said random number generator wherein at least one of said outcomes is associated with a reward accrued to a register of stored game credits exchangeable for real currency;

a plurality of non-wagering game terminals each having a non-wagering game terminal interface, said non-wagering game terminals configured to execute program instructions to conduct a non-wagering game having a virtual economy in which players utilize virtual currency to purchase features in said non-wagering game through said non-wagering game terminal interface, wherein said features alter or enhance said non-wagering game and wherein purchase of features is separate from purchase, if any, of play of said non-wagering game; and an account server in communication with said non-wagering game terminals and said wagering game terminal, said account server configured to store a virtual currency record for each of a plurality of players, each virtual currency record containing data representing a quantity of virtual currency at least a portion of which is accrued based on at least one of said outcome of said wagering game for said player, said award in said wagering game for said player, and said game credits at said game terminal for said player, said account server further programmed to receive a signal from said non-wagering game terminals representing the purchase of features within said non-wagering games and execute program instructions to debit said virtual currency record of virtual currency consumed through purchase of features in said non-wagering games at said non-wagering game terminals in response to said signal.

2. The system of claim 1 comprising at least two wagering game terminals in communication with one another, wherein each wagering game terminal is adapted to execute program instructions to conduct a game in cooperation with the other wagering game terminal.

3. The system of claim 1 comprising at least two wagering game terminals in communication with one another, wherein each wagering game terminal is adapted to execute program instructions to conduct a game in competition with the other wagering game terminal.

4. The system of claim 1 further comprising:

a player tracking server in communication with said wagering game terminal and said account server, said player tracking server adapted to store a player tracking record for each of a plurality of players, each player tracking record containing data representing a quantity of player units, at least a portion of which is earned based on play of said game of chance at said wagering game terminal such that at least said portion of said virtual currency is accrued based on said play of said game of chance at said wagering game terminal.

5. The system of claim 4 wherein at least a portion of said virtual currency is accrued based on said player units earned by said player.

6. The system of claim 5 wherein said virtual currency accrued is proportional to said player units.

7. The system of claim 5 wherein said virtual currency is accrued based on said player units up to a predetermined maximum limit of said player units.

8. The system of claim 5 wherein said virtual currency is accrued based on said player units above a predetermined minimum limit of said player units.

9. The system of claim 1 wherein virtual currency is categorized into types and said virtual currency record contains data representing a type of virtual currency.

10. A system for conducting a games for a plurality of players, said system comprising:

at least one wagering game terminal having a wagering game terminal interface and a random number generator, said wagering game terminal configured to execute program instructions to receive a wager through said wagering game interface and conduct a game of chance to generate at least one outcome based on a random number generated by said random number generator wherein at least one of said outcomes is associated with an award accrued to a register of stored game credits exchangeable for real currency;

a player tracking server in communication with said wagering game terminal, said player tracking server configured to store a player tracking record for each of a plurality of players, each player tracking record containing data representing a quantity of player units at least a portion of which is earned based on play of said game of chance at said wagering game terminal;

a plurality of non-wagering game terminals each having a non-wagering game terminal interface, said non-wagering game terminals configured to execute program instructions to conduct a non-wagering game having a virtual economy in which players utilize virtual currency to purchase features in said non-wagering game through said non-wagering game terminal interface, wherein said features alter or enhance said non-wagering game and wherein said purchase of features is separate from purchase, if any, of play of said non-wagering game; and an account server in communication with said non-wagering game terminals and said player tracking server, said account server configured to store a virtual currency record for each of a plurality of players, each virtual currency record containing data representing a quantity of virtual currency at least a portion of which is accrued based on play of said game of chance at said wagering game terminal, said account server further programmed to receive a signal from said non-wagering game terminals representing the purchase of features within said non-wagering games and execute program instructions to debit said virtual currency record of virtual currency consumed through purchase of features in said non-wagering games at said non-wagering game terminals in response to said signal.

11. The system of claim 10 comprising at least two wagering game terminals in communication with one another, wherein each wagering game terminal is adapted to execute program instructions to conduct a game in cooperation with the other wagering game terminal.

12. The system of claim 10 comprising at least two wagering game terminals in communication with one another, wherein each wagering game terminal is adapted to execute program instructions to conduct a game in competition with the other wagering game terminal.

13. The system of claim 10 wherein said account server is in communication with said wagering game terminal and at least a portion of said virtual currency is accrued based on at least one of said outcome of said wagering game for said player, said payout in said wagering game for said player, and said game credits at said game terminal for said player.

14. The system of claim 10 wherein at least a portion of said virtual currency is accrued based on said player units earned by said player.

15. The system of claim 10 wherein said virtual currency accrued is proportional to said player units.

16. The system of claim 10 wherein said virtual currency is accrued based on said player units up to a predetermined maximum limit of said player units.

17. The system of claim 10 wherein said virtual currency is accrued based on said player units above a predetermined minimum limit of said player units.

18. The system of claim 10 wherein virtual currency is categorized into types and said virtual currency record contains data representing a type of virtual currency.

19. A system for conducting a game for a plurality of players, said system comprising:

at least one wagering game terminal having a wagering game terminal interface and a random number generator, said wagering game terminal configured to execute program instructions to receive a wager through said wagering game interface and conduct a game of chance to generate at least one outcome based on a random number generated by said random number generator wherein at least one of said outcomes is associated with an award accrued to a register of stored game credits exchangeable for real currency; and a plurality of non-wagering game terminals each having a non-wagering game terminal interface, said non-wagering game terminals configured to execute program instructions to conduct a non-wagering game having a virtual economy in which players utilize virtual currency to purchase features in said non-wagering game through said non-wagering game terminal interface, wherein said features alter or enhance said non-wagering game and wherein said purchase of features is separate from purchase, if any, of play of said non-wagering game, each non-wagering game terminal accessing a virtual currency record containing data representing a quantity of virtual currency at least a portion of which is accrued based on play of said game of chance at said wagering game terminal, and debit virtual currency stored within said virtual currency record for purchase of features in said non-wagering games at said non-wagering game terminals.

20. The system of claim 19 further comprising an account server in communication with said non-wagering game terminals and said wagering game terminal, said account server adapted to store a virtual currency record for each of a plurality of players, each virtual currency record containing data representing a quantity of virtual currency at least a portion of which is accrued based on at least one of said outcome of said wagering game for said player, said award in said wagering game for said player, and said game credits at said game terminal for said player, said account server further adapted to receive a signal from said non-wagering game terminals representing the purchase of features within said non-wagering games and execute program instructions to debit said virtual currency record of virtual currency consumed through purchase of features in said non-wagering games at said non-wagering game terminals in response to said signal.

* * * * *